US007299867B2

(12) United States Patent
Hall et al.

(10) Patent No.: US 7,299,867 B2
(45) Date of Patent: Nov. 27, 2007

(54) HANGER MOUNTED IN THE BORE OF A TUBULAR COMPONENT

(75) Inventors: David R. Hall, Provo, UT (US); Michael A. Briscoe, Lehi, UT (US)

(73) Assignee: IntelliServ, Inc., Provo, UT (US)

( * ) Notice: Subject to any disclaimer, the term of this patent is extended or adjusted under 35 U.S.C. 154(b) by 158 days.

(21) Appl. No.: 11/162,469

(22) Filed: Sep. 12, 2005

(65) Prior Publication Data

US 2007/0056723 A1 Mar. 15, 2007

(51) Int. Cl.
*E21B 17/02* (2006.01)
*H01R 4/60* (2006.01)

(52) U.S. Cl. ..... 166/242.1; 403/34; 403/313; 439/207

(58) Field of Classification Search ..... 166/242.1, 166/242.6, 241.1, 65.1; 403/34, 309, 313; 439/190, 194, 207
See application file for complete search history.

(56) References Cited

U.S. PATENT DOCUMENTS 2,414,719 A 1/1947 Cloud
2,906,502 A * 9/1959 Smith ..... 175/6
3,518,608 A 6/1970 Papadopoulos
4,095,865 A 6/1978 Denison et al.
4,121,193 A * 10/1978 Denison ..... 340/855.1
4,591,226 A * 5/1986 Hargett et al. ..... 439/192
4,739,325 A 4/1988 MacLeod
4,788,544 A 11/1988 Howard
6,012,015 A 1/2000 Tubel
6,252,518 B1 6/2001 Laborde
6,392,317 B1 5/2002 Hall et al.
6,515,592 B1 2/2003 Babour et al.
6,641,434 B2 11/2003 Boyle et al.
6,655,464 B2 * 12/2003 Chau et al. ..... 166/380
6,670,880 B1 12/2003 Hall et al.
6,688,396 B2 2/2004 Floerke et al.
6,717,501 B2 4/2004 Hall et al.
6,799,632 B2 10/2004 Hall et al.

(Continued)

FOREIGN PATENT DOCUMENTS

JP 08280123 A * 10/1996

OTHER PUBLICATIONS

PCT/US03/16475, Published Dec. 4, 2003, Applicant Baker Hughes; International Search Report: "Documents Considered to Be Relevant".

*Primary Examiner*—Kenneth Thompson
(74) *Attorney, Agent, or Firm*—Tyson J. Wilde; Jeffery E. Daly

(57) ABSTRACT

A hanger mounted within a bore of a tubular string component has a split ring, a tapered key and a passageway formed in the hanger. The split ring has interfacial surfaces cooperating with interfacial surfaces of the tapered key. The bore may be located within a tubular string component selected from pipe, drill pipe, doubled shouldered pipe, single shouldered pipe, drill collars, reamers, production pipe, composite pipe, well casing, risers, underground utility lines, rotors, positive displacement rotors, jars, shock absorbers, heavy weight drill pipe, hammers, and turbines. A conduit or electronic equipment may be disposed within the passageway. The passageway may be formed in the tapered key or in the split ring. A transmission element may also be disposed within a groove formed in the hanger.

23 Claims, 18 Drawing Sheets

U.S. PATENT DOCUMENTS 6,821,147 B1 11/2004 Hall et al.
6,830,467 B2 12/2004 Hall et al.
6,844,498 B2 1/2005 Hall et al.
6,866,306 B2 3/2005 Boyle et al.
6,888,473 B1 5/2005 Hall et al.
6,913,093 B2 7/2005 Hall et al.
6,929,493 B2 8/2005 Hall et al.
6,945,802 B2 9/2005 Hall et al.
2002/0170612 A1 11/2002 Penza
2004/0039466 A1 2/2004 Lilly et al.
2004/0104797 A1 6/2004 Hall et al.
2004/0113808 A1 6/2004 Hall et al.
2004/0145492 A1 7/2004 Hall et al.
2004/0150532 A1 8/2004 Hall et al.
2004/0164833 A1 8/2004 Hall et al.
2004/0164838 A1 8/2004 Hall et al.
2004/0216847 A1 11/2004 Hall et al.
2004/0244916 A1 12/2004 Hall et al.
2004/0244964 A1 12/2004 Hall et al.
2004/0246142 A1 12/2004 Hall et al.
2005/0001735 A1 1/2005 Hall et al.
2005/0001736 A1 1/2005 Hall et al.
2005/0001738 A1 1/2005 Hall et al.
2005/0035874 A1 2/2005 Hall et al.
2005/0035875 A1 2/2005 Hall et al.
2005/0035876 A1 2/2005 Hall et al.
2005/0036507 A1 2/2005 Hall et al.
2005/0039912 A1 2/2005 Hall et al.
2005/0045339 A1 3/2005 Hall et al.
2005/0046586 A1 3/2005 Hall et al.
2005/0046590 A1 3/2005 Hall et al.
2005/0067159 A1 3/2005 Hall et al.
2005/0070144 A1 3/2005 Hall et al.
2005/0082092 A1 4/2005 Hall et al.
2005/0092499 A1 5/2005 Hall et al.
2005/0093296 A1 5/2005 Hall et al.
2005/0095827 A1 5/2005 Hall et al.
2005/0115717 A1 6/2005 Hall et al.
2005/0145406 A1 7/2005 Hall et al.
2005/0150653 A1 7/2005 Hall et al.
2005/0161215 A1 7/2005 Hall et al.
2005/0173128 A1 8/2005 Hall et al.
2005/0212530 A1 9/2005 Hall et al.
2005/0236160 A1 10/2005 Hall et al.

* cited by examiner

HANGER MOUNTED IN THE BORE OF A TUBULAR COMPONENT

BACKGROUND OF THE INVENTION

In the oil and gas industry, communication between downhole and surface equipment may facilitate a more efficient drilling or production operation. Several recent developments in the art, such as disclosed in U.S. Pat. Nos. 6,670,880; 6,688,396; 6,929,493; and 6,641,434, which are all herein incorporated by reference for all that they disclose, teach incorporating a data transmission system into downhole tool strings.

U.S. Pat. No. 6,799,632 discloses a liner for an annular downhole component comprising an expandable metal tube having indentations along its surface. The tube is inserted into the annular component and deformed to match an inside surface of the component. The tube may be expanded using a hydroforming process or by drawing a mandrel through the tube. The tube may also be useful for positioning conduit and insulated conductors within the component. The '632 patent is herein incorporated by reference for all that it discloses.

U.S. Patent Publication No. 2002/0170612 discloses carrier and support means for routing cable structures in existing pipelines. The carriers comprise coiled or folded cylinders or sections thereof bearing or adapted to bear a cable support means. Also disclosed is a method of fixing such carriers to the interior of pipelines and routing cable structures by means of such devices and methods. The '612 publication is herein incorporated by reference for all that it discloses.

U.S. Pat. No. 4,095,865 discloses a means for holding a conduit against the wall of a pipe. A particular arrangement comprises a conduit that is formed into a curved resilient structure having a shape, such as a helix, that tends to increase in diameter by an amount such that all portions of the conduit are resiliently biased to press against the pipe wall. The '865 patent is herein incorporated by reference for all that it discloses.

U.S. Pat. No. 6,866,306 discloses a first flux-loop inductive coupler element electrically coupled with a second flux-loop inductive coupler element. In an embodiment the coupler elements are within the bores of drill pipe.

BRIEF SUMMARY OF THE INVENTION

The present invention is a hanger mounted within a bore of a tubular string component. The hanger has a split ring and a tapered key adapted to fix the hanger against the bore. The split ring has interfacial surfaces cooperating with interfacial surfaces of the tapered key and there is at least one passageway formed within the hanger. The bore may be located within a tubular string component selected from pipe, drill pipe, drill collars, reamers, production pipe, composite pipe, well casing, risers, underground utility lines, rotors, positive displacement rotors, jars, shock absorbers, heavy weight drill pipe, hammers, and turbines.

A transmission element may also be disposed within a groove formed in the hanger. The transmission element may communicate with a network in a variety of environments, such as downhole drilling and oil production networks. The transmission element may be selected from direct electrical couplers, optical couplers, and inductive couplers.

The hanger may comprise a plurality of passageways, which may be adapted to retain conduits and/or electronic equipment. The hanger may be locked in a position within the bore. This may be advantageous so that the hanger doesn't slip within the bore. For example, the hanger may be disposed within a recess formed in the bore. The split ring and tapered key may comprise a beveled end, which may help lock the hanger within the recess. In some embodiments the hanger may be segmented. It may be desirable to retain a portion of the conduit within a portion of the bore which has a larger diameter than the diameter of the entrance into the bore. In such situations, the split ring may be a flexible sleeve. When the tapered key is inserted into the flexible sleeve, the sleeve may expand and engage the diameter of the bore. The cooperating interfacial surfaces may comprise an anti-sliding lock, such as a protrusion formed in the tapered key which fits into a groove formed in the interfacial surfaces of the split ring. The anti-sliding lock may help retain the tapered key within the split ring.

An interface between the hanger and the bore may comprise an anti-rotation lock. The anti-rotation lock may comprise a pin or the anti-rotation lock may be formed in the hanger and/or bore. The interface between the hanger and the bore may also be non-uniform which may prevent the hanger from sliding within the bore.

In order for the interfacial surfaces to cooperate with each other, it may not be necessary for the faces to be exactly complementary to each other. For example, if the tapered key comprises an interfacial surface with a taper of 10 degrees per inch, it may be sufficient for the interfacial surface of the split ring to have a taper within a range of 1 to 20 inches per inch or vice versa. Further, in some embodiments the interfacial surfaces of the split ring may not be flat. It is necessary that when the tapered key is fitted within the spilt of the split ring, that there be sufficient contact between the interfacial surfaces such that the tapered key is held within the split.

A conduit retained in the passageway may comprise a transmission medium selected from coaxial cables, twisted pairs of wires, triaxial cables, twinaxial cables, ribbon cables, optical fibers, and copper wires. The conduit may be anchored within the passageway. For example a ferrule may be wedge in the passageway which secures the portion of the conduit within the passageway. In other aspects of the invention, the passageway may be tapered to help retain electrical equipment or conduits within the passageway. The conduit may also terminate within the passageway, which may allow a portion of a transmission element or a portion of another conduit to also be secured within the passageway, thus allowing the transmission element or another conduit to communicate with the conduit.

The hanger may comprise electrical equipment, which may be disposed within the passageway. The electrical equipment may be selected from generators, batteries, microcontrollers, radio identification tags, switches, modems, optical regenerators, routers, memory, wireless transceivers, digital/optical converters, analog/optical converters, capacitors, sensors, switches, repeater and amplifiers.

DETAILED DESCRIPTION OF THE INVENTION AND THE PREFERRED EMBODIMENT

Figure 1:
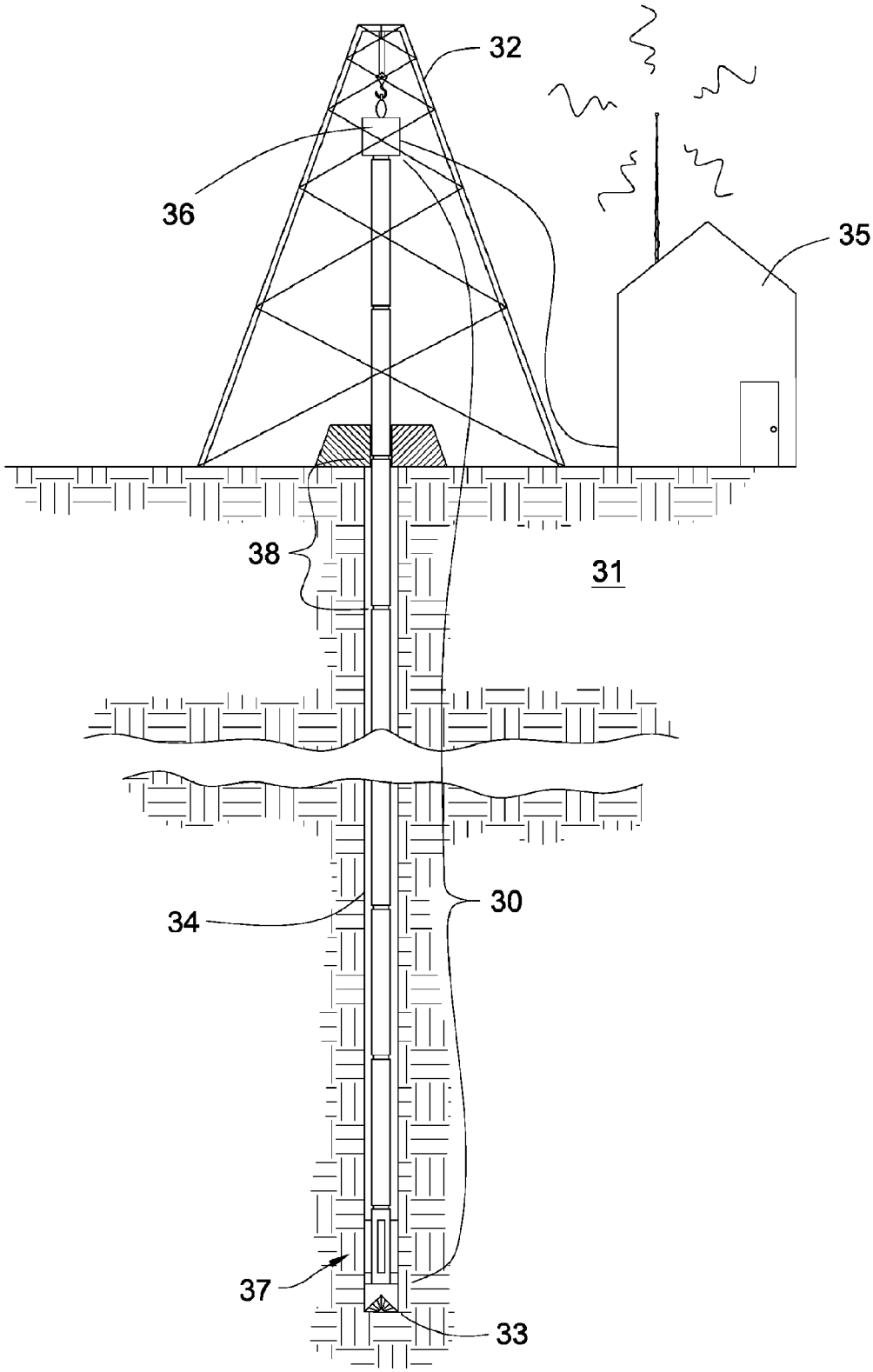
FIG. 1 is a perspective diagram of a downhole tool string suspended within the earth.

FIG. 1 is a perspective diagram of a downhole tool string 30 suspended in the earth 31. A derrick 32 supports the tool string 30. The tool string 30 may be made up of a plurality of tubular components 38. The tubular components 38 may be production pipe, drill pipe, single shouldered pipe, double shouldered pipe, drill collars, heavy weight pipe, reamers, motors, composite pipe, subs, swivels, jars, hammers, shock absorbers, or downhole equipment 37 such as may be included in bottom hole assemblies. Downhole tools, such as those located near the bottom 33 of the borehole 34, may communicate with surface equipment 35 through a downhole telemetry system. A swivel connection 36 may transmit data, power, network packets, or combinations thereof between the tool string 30 and the surface equipment 35. Alternatively, a wireless transceiver may be used to communicate between the surface equipment and the downhole equipment.

Figure 2:
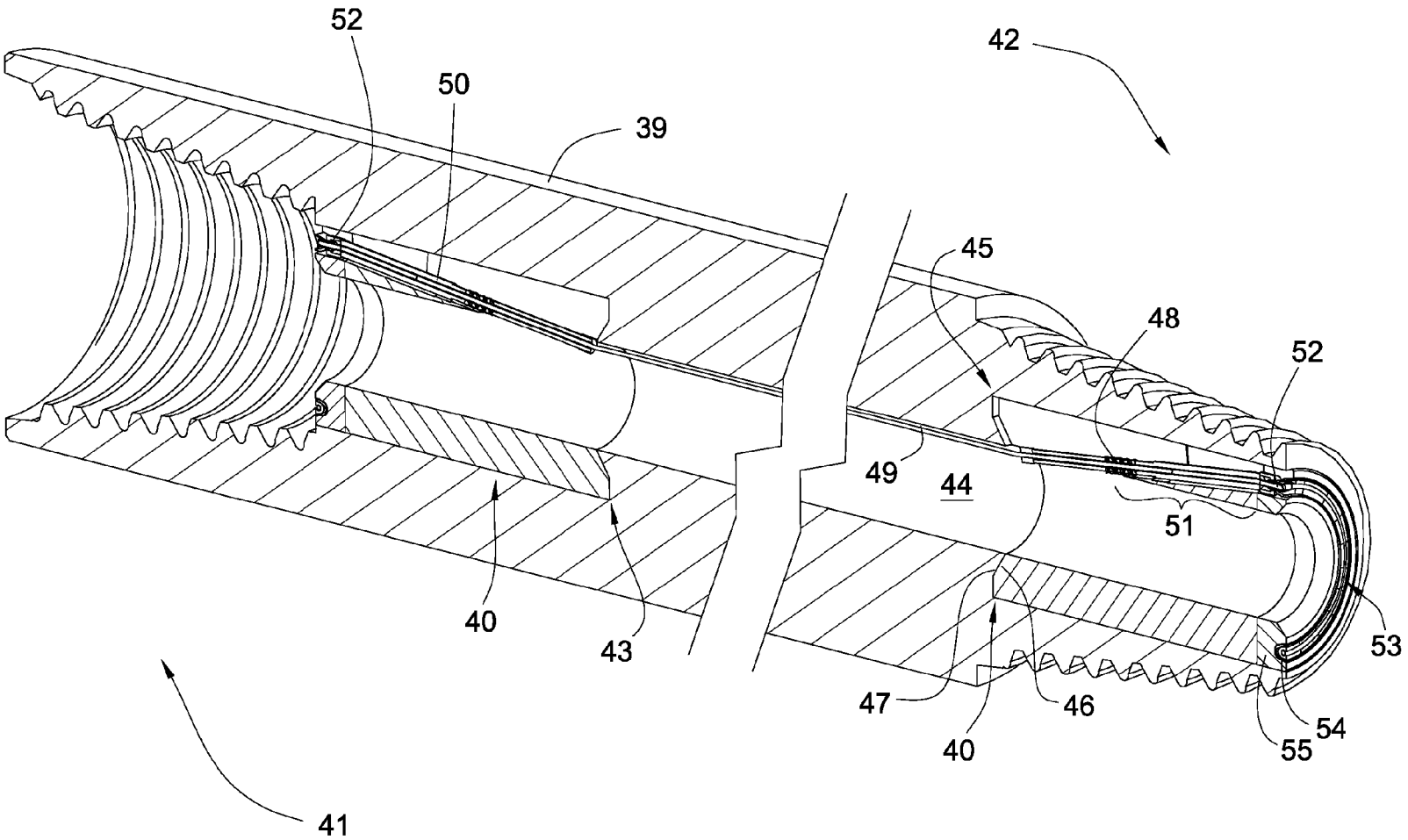
FIG. 2 is a perspective cross sectional diagram of a drill pipe comprising hangers on each end.

FIG. 2 is a perspective cross sectional diagram of a drill pipe 39 comprising hangers 40 on each end 41, 42. The hangers 40 are locked in a position 43 within the bore 44 of the pipe 39 since the hangers 40 are disposed within a recess 45 formed in the bore 44. The hangers 40 comprise a beveled end 46 which mates with a corresponding bevel 47 formed in the recess 45. A passageway 49 formed in the hanger 40 retains a conduit 48 within the bore 44. A ferrule 50 anchors a portion 51 of the conduit 48 within the passageway 49. The conduit 48 may comprise a transmission medium selected from coaxial cables, twisted pairs of wires, triaxial cables, twinaxial cables, ribbon cables, optical fibers, and copper wires. Further the conduit 48 shown in FIG. 2 terminates within the passageway 49 of each hanger 40. This is advantageous so that a lead-in 52 of a replaceable transmission element 53 may communicate with the conductive medium. The transmission element 53 may be selected from direct electrical couplers, inductive couplers, and optical couplers. The transmission element 53 is disposed within a groove 54 formed in an insert 55 adjacent the hanger 40. A transmission element 53 that may be compatible with the present invention is disclosed in U.S. Pat. No. 6,670,880 (referenced in the background of this specification).

Although the present invention is compatible in a drill pipe, the present invention may be adapted to retain a conduit or electrical equipment within an opening in other situations, such as in cylindrical objects such as production pipe, well casing, risers, utility lines, sewer mains, water mains, rotors, turbines, generators, positive displacement rotors, hydraulics lines, and plumbing pipe.

Figure 3:
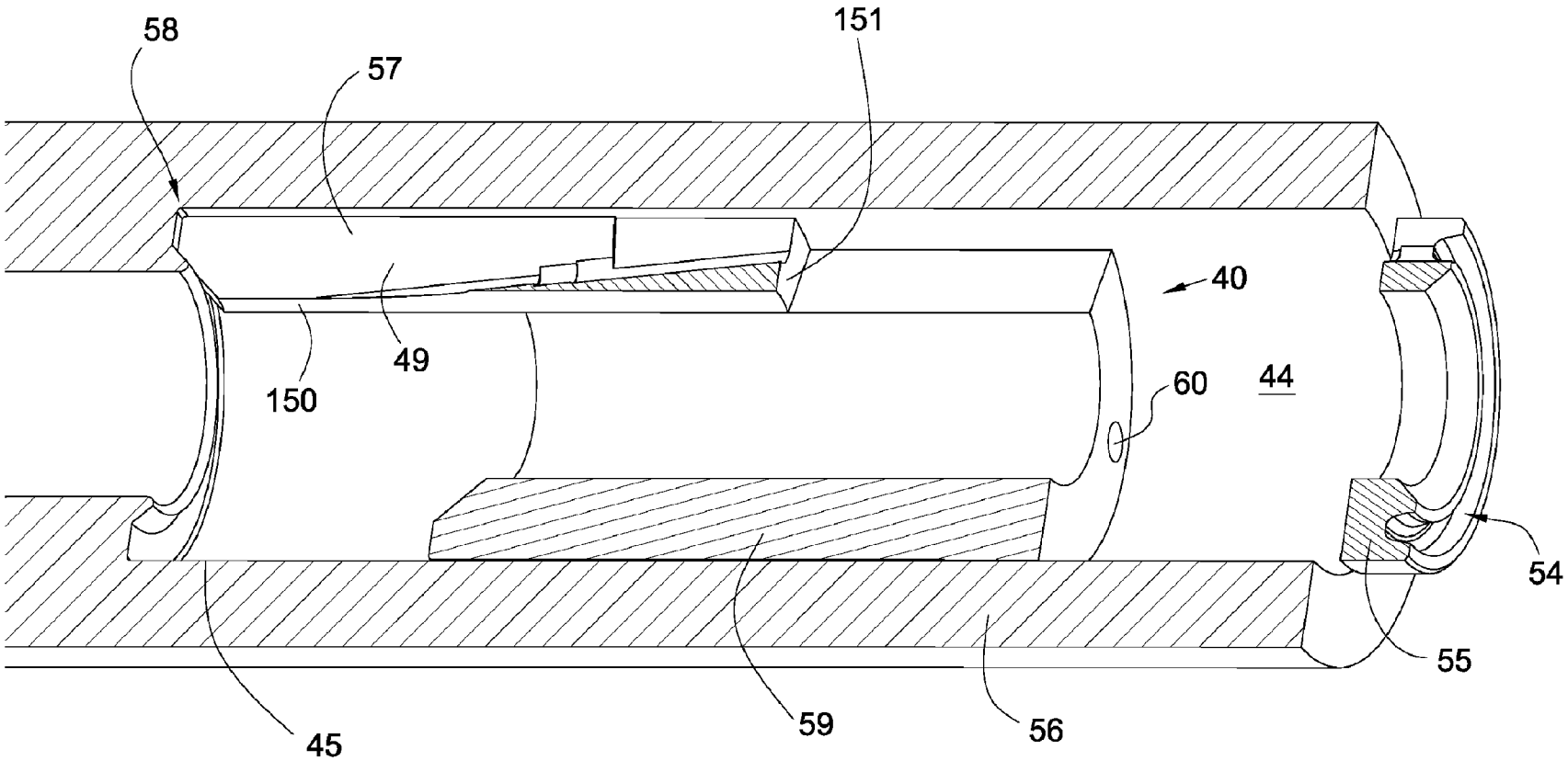
FIG. 3 is an exploded cross sectional diagram of a hanger.

FIG. 3 is an exploded cross sectional diagram of a hanger 40. The hanger 40 is shown within a cylindrical object 56 comprising a bore 44. A tapered key 57 comprising a beveled end 58 is disposed within a recess 45 formed within the bore 44. A split ring 59 is positioned within the bore 44. The shape of the tapered key 57 fixes the split ring 59 against the bore 44. A passageway 49 connecting a first and second surface 150, 151 is formed within the tapered key 57. An aperture 60 adapted to comprise a pin to be used as an anti-rotation lock is formed in the split ring 59. Further an insert 55 comprising a groove 54 for a transmission element is adjacent the hanger 40. Alternatively, the passageway 49 may be formed in the split ring 59.

Figure 4:
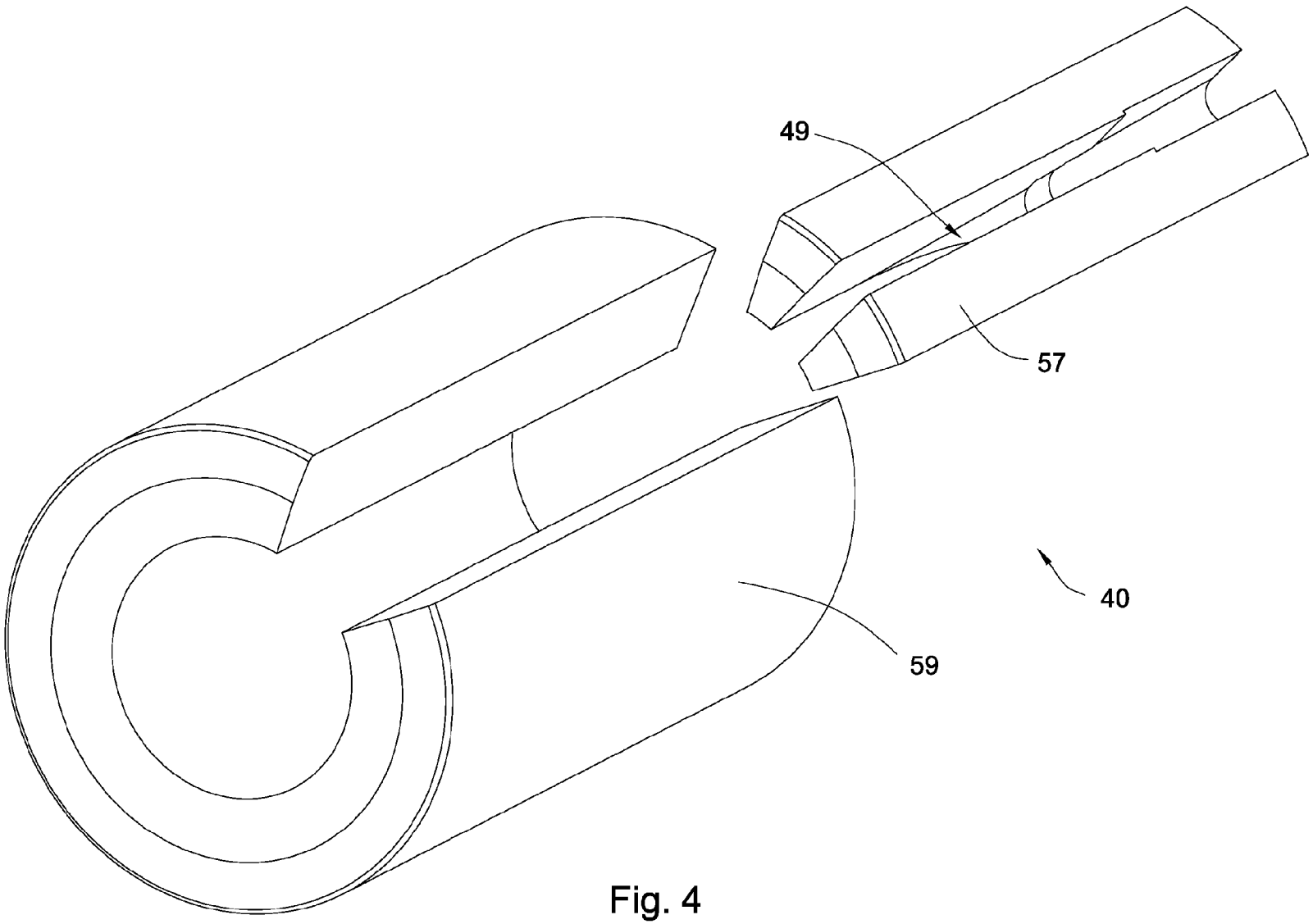
FIG. 4 is an exploded diagram of a hanger.
Figure 5:
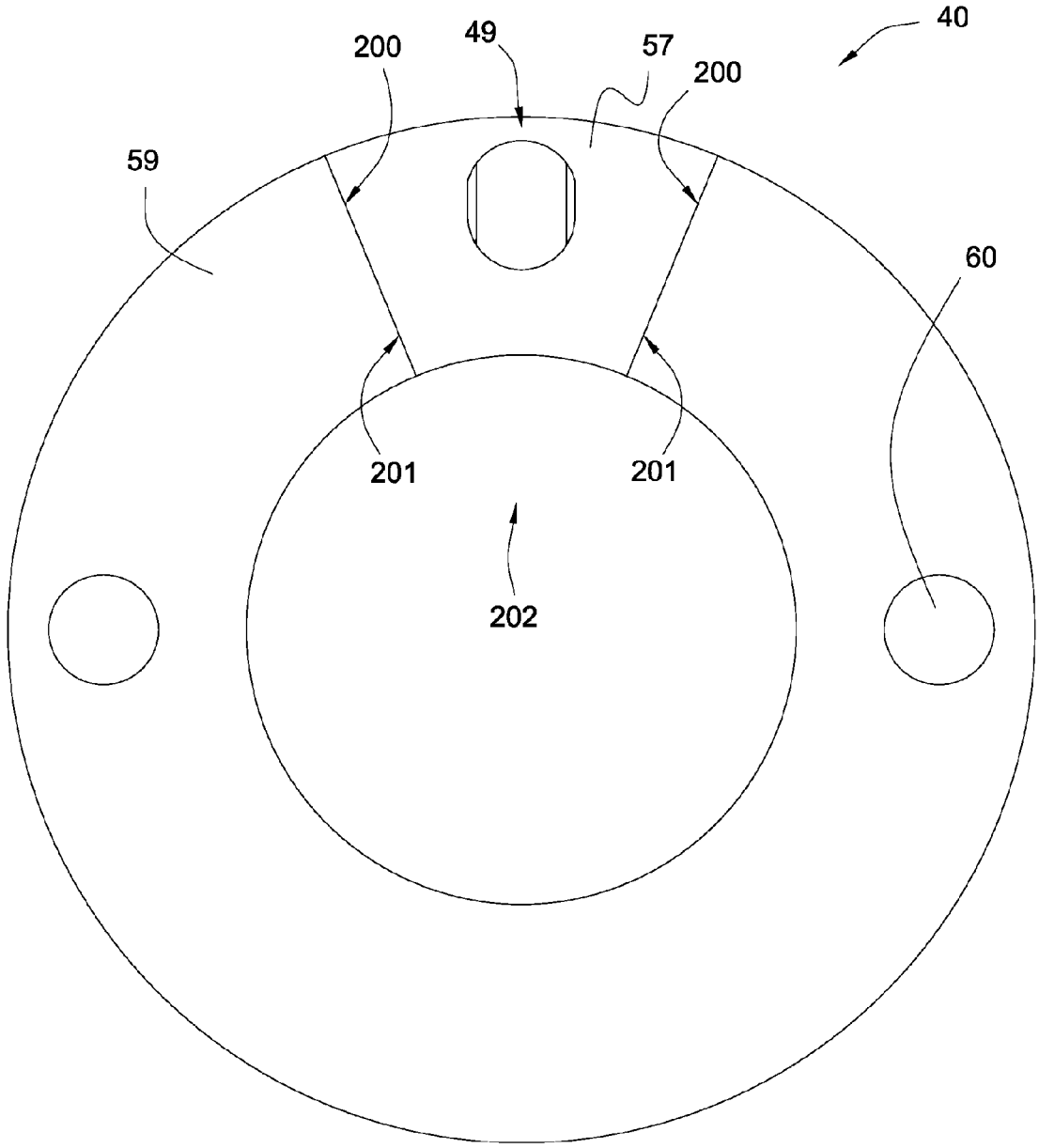
FIG. 5 is a top diagram of a hanger.

FIG. 4 is an exploded diagram of a hanger 40, which depicts the shape of the tapered key 57. The passageway 49 is also formed in the tapered key 57. The tapered key 57 may be sufficiently large enough to exert a force on the split ring 59, such that the split ring 59 is held against the bore 44 due to compression. FIG. 5 is a top diagram of a hanger 40 comprising a split ring 59, a tapered key 57, an enclosed passageway 49, and two apertures 60 for anti-rotation locks.

It should be noted that in order for the interfacial surfaces 200, 201 to cooperate with each other, it may not be necessary for the surfaces 200, 201 to be exactly complementary to each other. For example, if the tapered key 57 comprises an interfacial surface 200 with a taper of 10 degrees per inch, it may be sufficient for the interfacial surface 201 of the split ring 59 to have a taper within a range of 1 to 20 inches per inch or vice versa. It is necessary that when the tapered key 57 is fitted within the spilt 202 of the split ring 59, that there be sufficient contact between the interfacial surfaces 200, 201 such that the tapered key 57 is held within the split 202.

Figure 6:
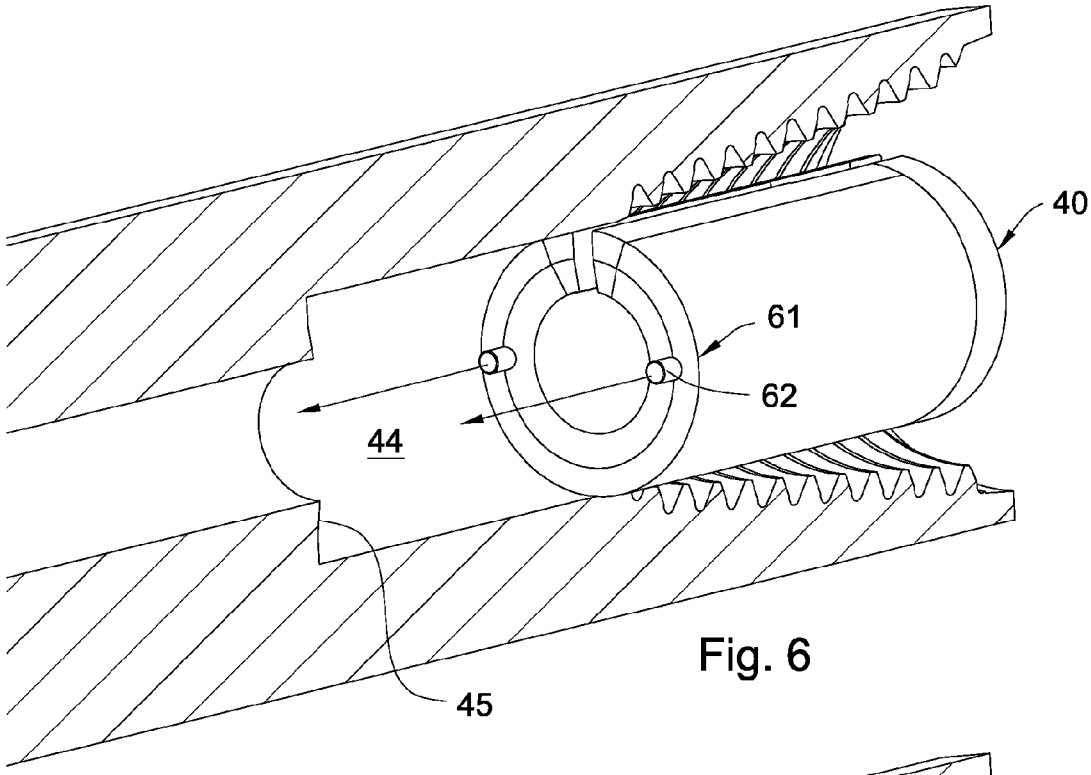
FIG. 6 is a perspective diagram of an anti-rotation lock.
Figure 7:
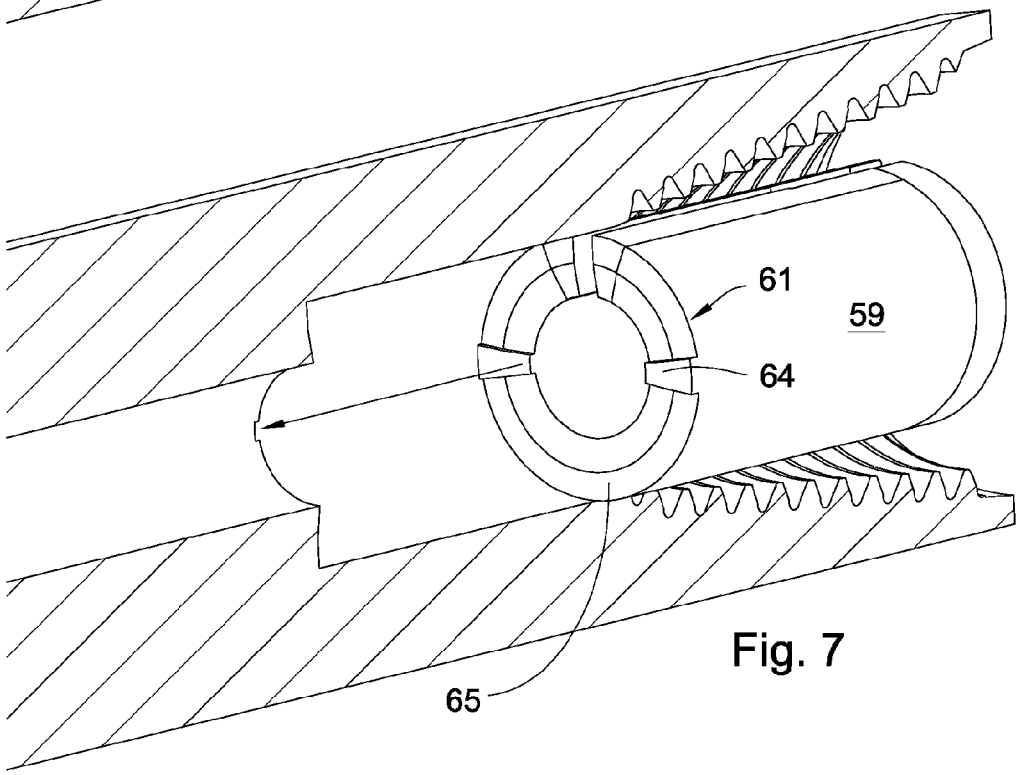
FIG. 7 is a perspective diagram of another embodiment of an anti-rotation lock.
Figure 8:
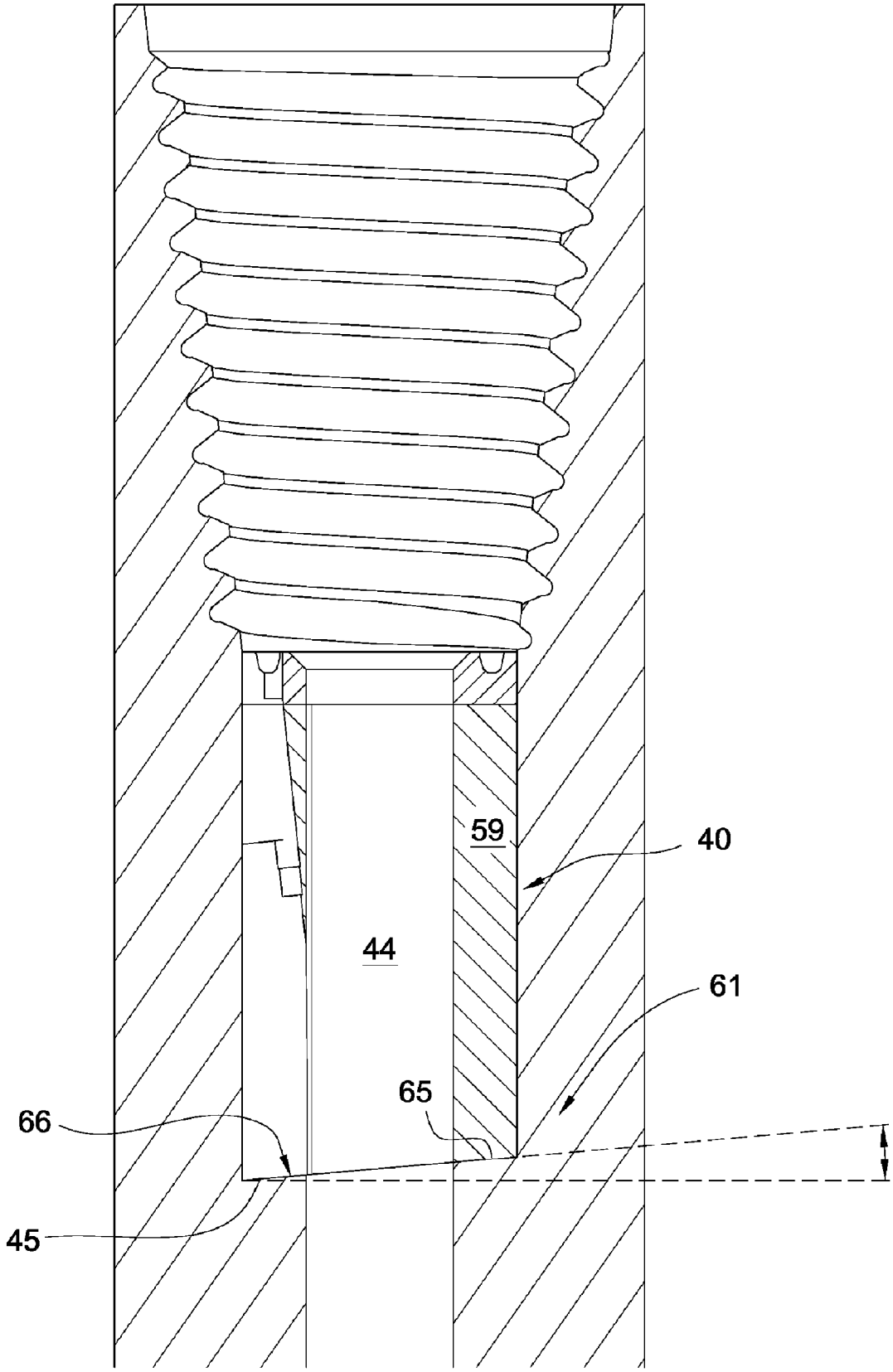
FIG. 8 is a cross sectional diagram of another embodiment of an anti-rotation lock.

FIG. 6 is a perspective diagram of an anti-rotation lock 61 formed in the interface between the hanger 40 and the bore 44. Anti-rotation pins 62 are disposed within the apertures 60 shown in FIG. 5. The pins 62 are insertable into grooves (not shown) formed in the recess 45 of the bore 44. Protrusions 64 formed in the end 65 of the split ring 59 may also form an anti-rotation lock 61 as shown in FIG. 7. FIG. 8 is a cross sectional diagram of another embodiment of an anti-rotation lock 61. The interface 66 between the recess 45 in the bore 44 and the end 65 of the split ring 59 are angled, such that the hanger 40 can not rotate within the bore 44.

Figure 9:
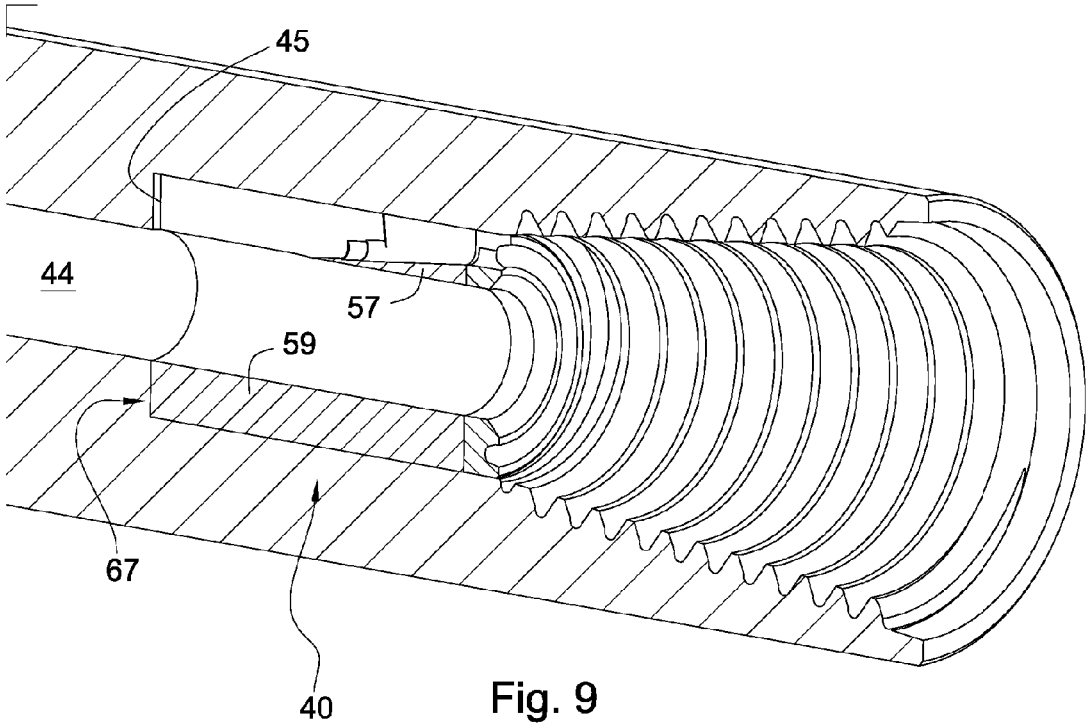
FIG. 9 is a perspective cross sectional diagram of a hanger comprising a flat end.
Figure 10:
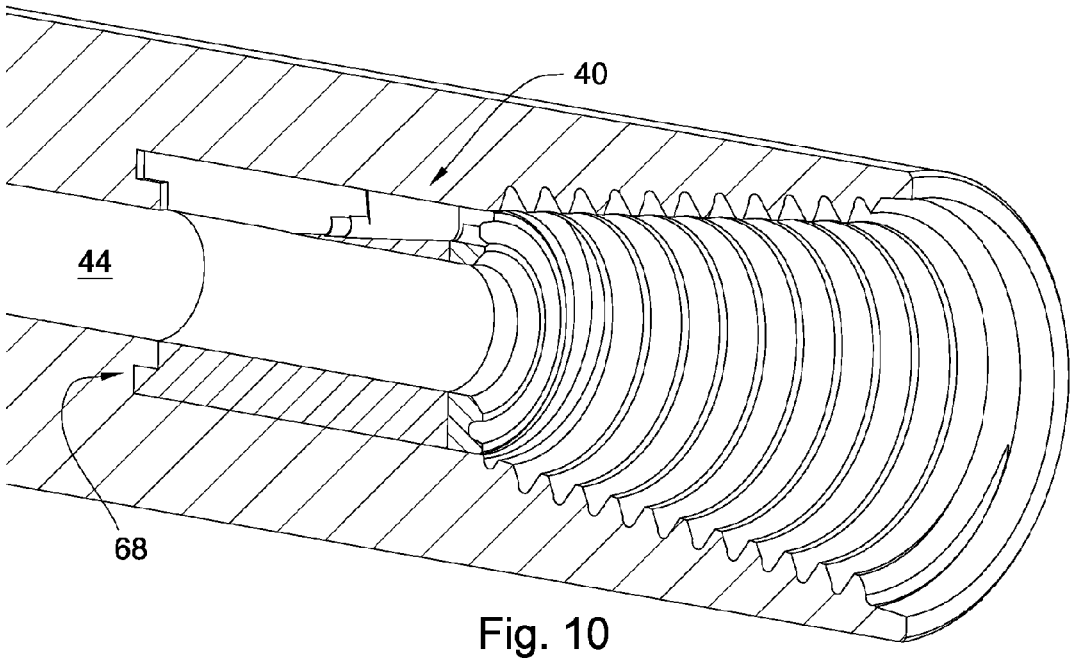
FIG. 10 is a perspective cross sectional diagram of a hanger comprising a non-uniform end.

FIG. 9 is a perspective cross sectional diagram of a hanger 40 comprising a flat end 67. The flat end 67 may interact with the recess 45 formed in the bore 44. In this embodiment, the tapered key 57 may be large enough to bias the split ring 59 such that the hanger 40 is held against the bore 44 due to compression. In other embodiments, the hanger 40 may comprise a non-uniform end 68, such as shown in FIG. 10, to help retain the hanger 40 within the bore 44.

Figure 11:
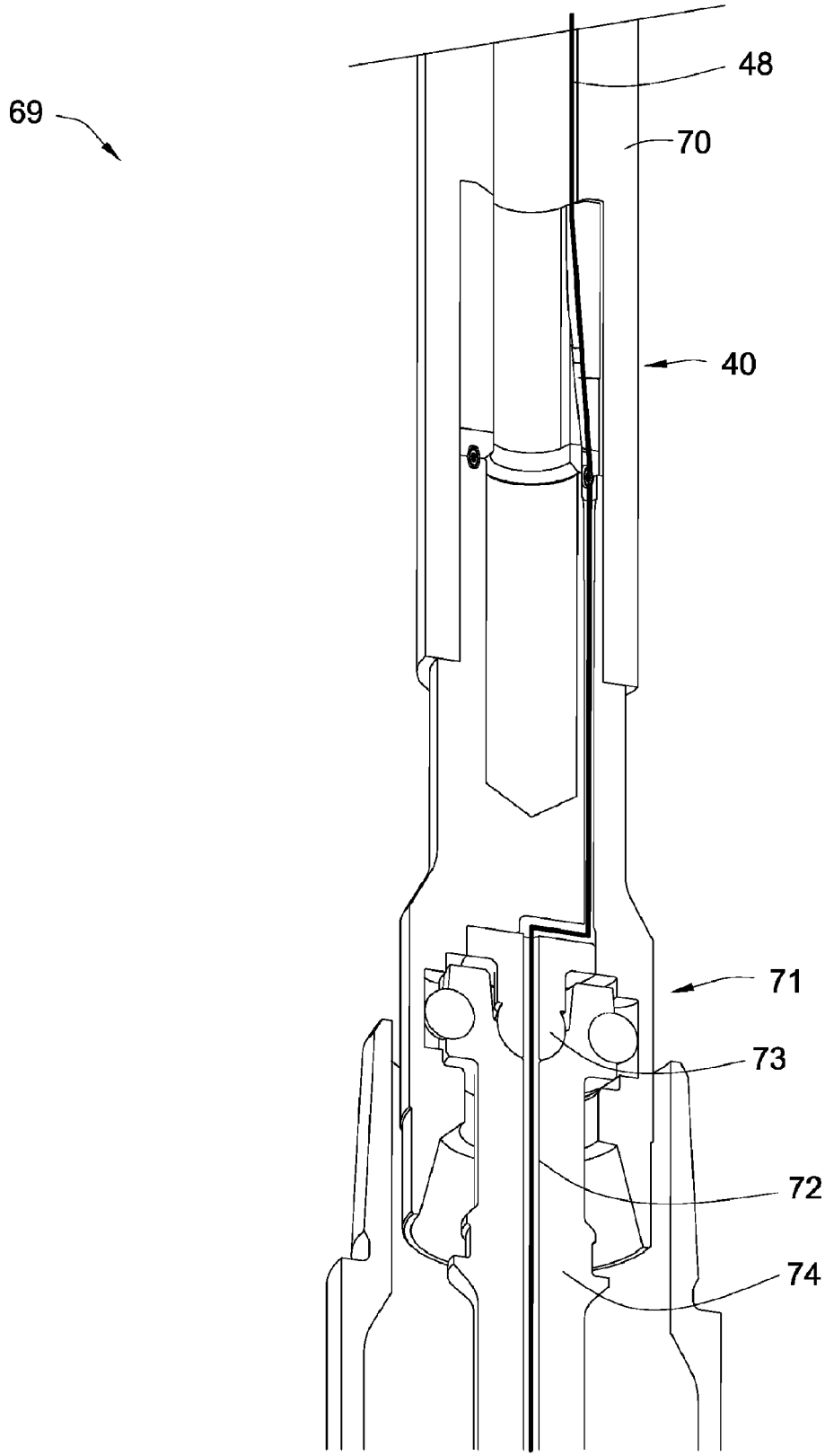
FIG. 11 is a perspective cross sectional diagram of a hanger disposed within a rotor.

FIG. 11 is a perspective cross sectional diagram of a hanger 40 disposed within a rotor 70. The rotor 70 may be part of a motor assembly 69 located in a drill string. In the figure, a positive displacement rotor 70 is shown, but a turbine rotor may also be used. Since a motor assembly 69 disposed within a drill string may have many parts, it may be desirable to route a conduit 48 comprising a conductive medium through the rotor 70 instead of routing a conduit through housing surrounding the rotor 70. The conductive medium may be used for communication between equipment above and below the motor assembly 69, such as instrumentation near the drill bit and surface equipment 35 (shown in FIG. 1). In embodiments where a positive displacement motor 70 is used, the rotor 70 may nutate as fluid from the drill string rotates the rotor 70. A U-joint 71 positioned below the rotor 70 may help transfer the nutational rotation into a coaxial rotation. Since the U-joint 70 may move within a limited range, a passageway 72 that extends through the ball 73 and into a shaft 74 may be wide enough to accommodate the conduit 48 without transferring undue stress to the conduit 48.

Figure 12:
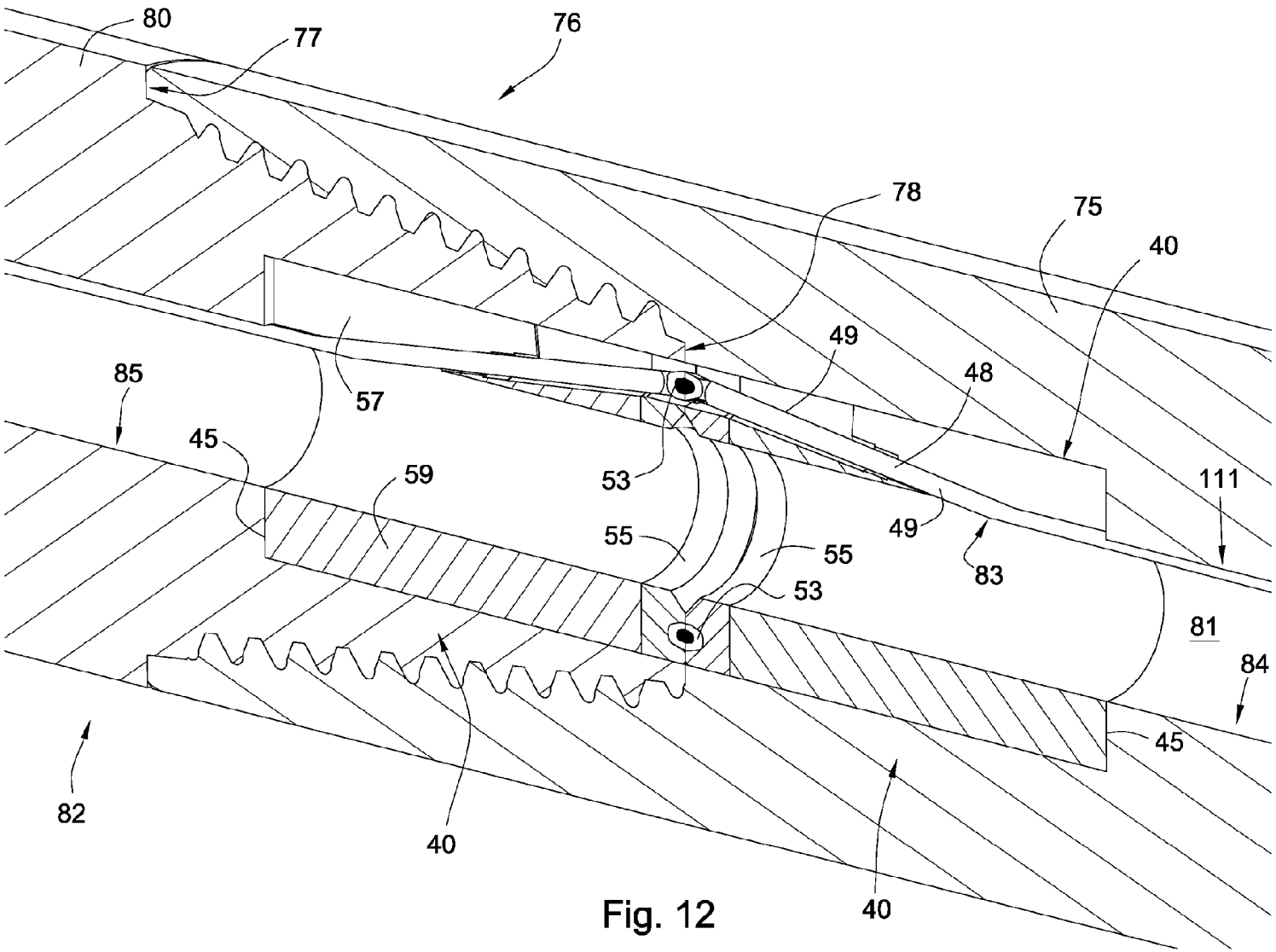
FIG. 12 is a perspective cross sectional diagram of a hanger disposed within double shoulder pipe.

FIG. 12 is a perspective cross sectional diagram of a hanger 40 disposed within double shouldered pipe 75. Double shouldered pipe 75 may be defined as a pipe 75 comprising an end 76 with a primary shoulder 77 and a secondary shoulder 78; and when a pipe joint is made up with a similar pipe 80 a load is transferred through both shoulders 77, 78. A preferred double shouldered pipe is disclosed in U.S. Pat. No. 5,908,212 to Grant Prideco, Inc. of Woodlands, Tex., the entire disclosure of which is incorporated herein by reference. The hangers 40 may be disposed within recesses 45 formed in the bore 81 of both pipes 75, 80. An insert 55 may be adjacent and comprise a transmission element 53 which is in communication with the conductive medium in the conduits 48. When the ends 76, 82 of the pipes 75, 80 are torqued together, the transmission elements 53 may come into close enough contact that the conductive medium in the conduits 48 may communicate with each other. The conduits may comprise a bend 83 to align the conduit 48 next to the bore wall 84, 85 of the pipes 75, 80.

When assembling a conduit 48 into a pipe 75 it may be advantageous to secure one end of the conduit 48 to an end (not shown) of the pipe 75 within the bore 81. The other end 76 of the conduit 48 may be secured within the passageway 49 formed within the tapered key 57. Since the tapered key 57 is smaller than the split ring 59, the portion of the conduit 48 may be secured in a portion 111 of the bore 81 which is too narrow for the split ring 59. Then after the portion of the conduit 48 is secured within the passageway 49, the tapered key 57 may be pulled into the recess 45, stretching the conduit 48 tight. The split ring 59 may then be placed adjacent the tapered key 57 within the recess 45 and hold the tapered key 57 in place.

Figure 13:
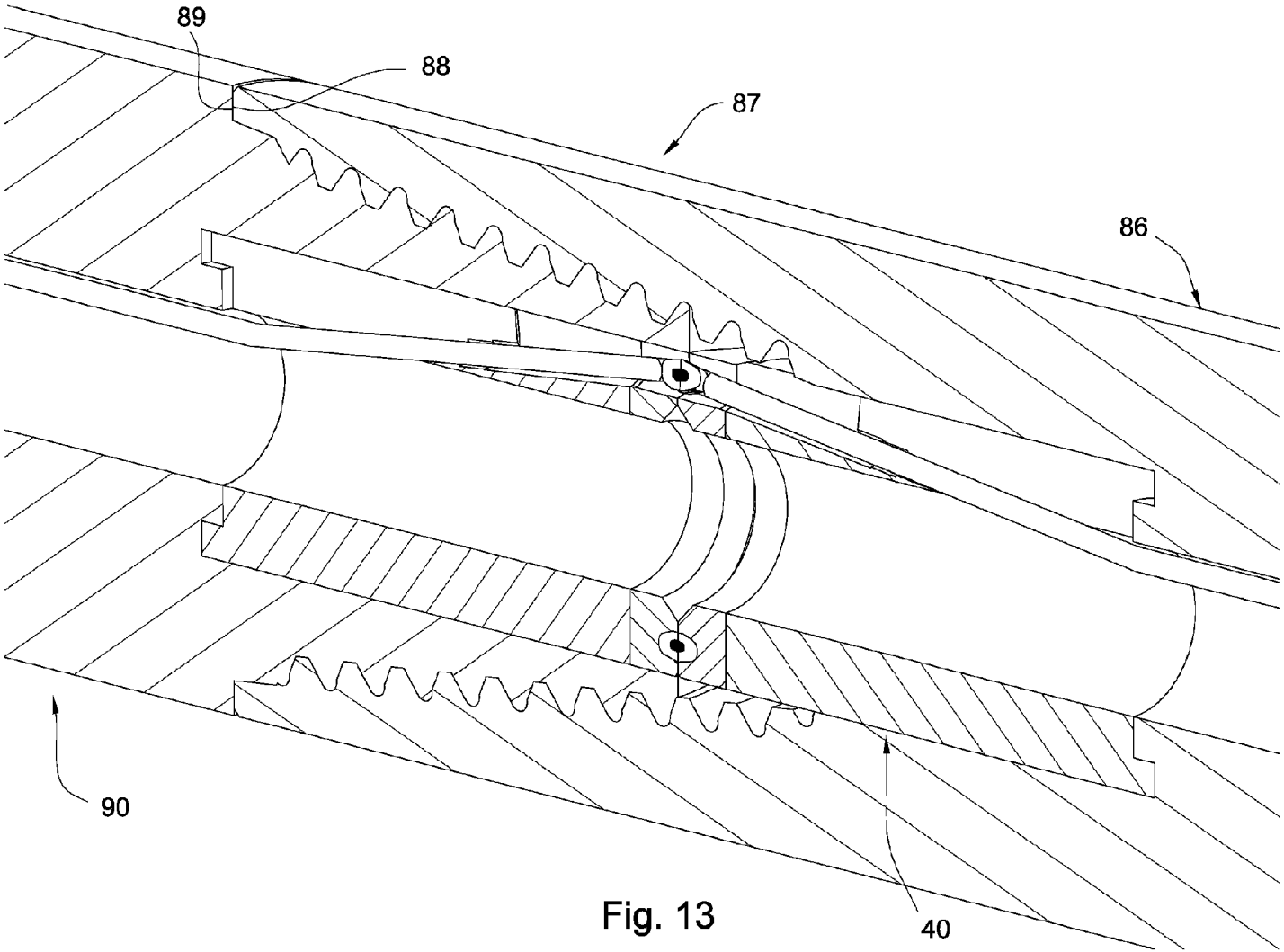
FIG. 13 is a perspective cross sectional diagram of a hanger disposed within single shouldered pipe.

FIG. 13 is a perspective cross sectional diagram of a hanger 40 disposed within single shouldered pipe 86. Single shouldered pipe 86 may be defined as a pipe 86 comprising an end 87 with a primary shoulder 88 and when a pipe joint is made up with an end 89 of a similar pipe 90, the primary shoulder 88 bears the load.

In alternative embodiments, the hanger may be disposed in downhole tools where a portion of the load is transferred from one tool to the other through the threads of the connection.

Figure 14:
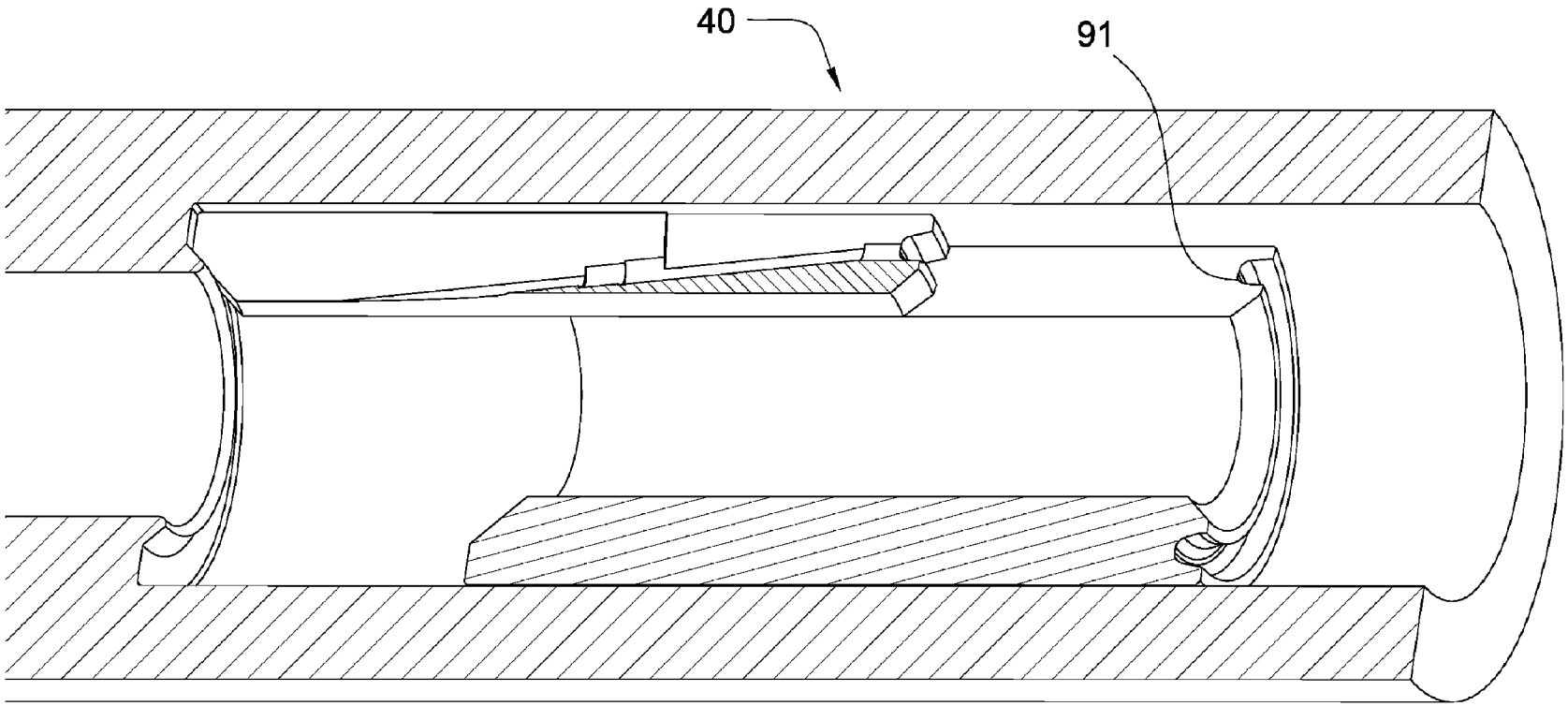
FIG. 14 is an exploded cross sectional diagram of a groove formed in the hanger.

FIG. 14 is an exploded cross sectional diagram of a groove 91 formed directly in the hanger 40. This may be advantageous such that the hanger 40 may retain a transmission element 53 (as shown in FIG. 2).

Figure 15:
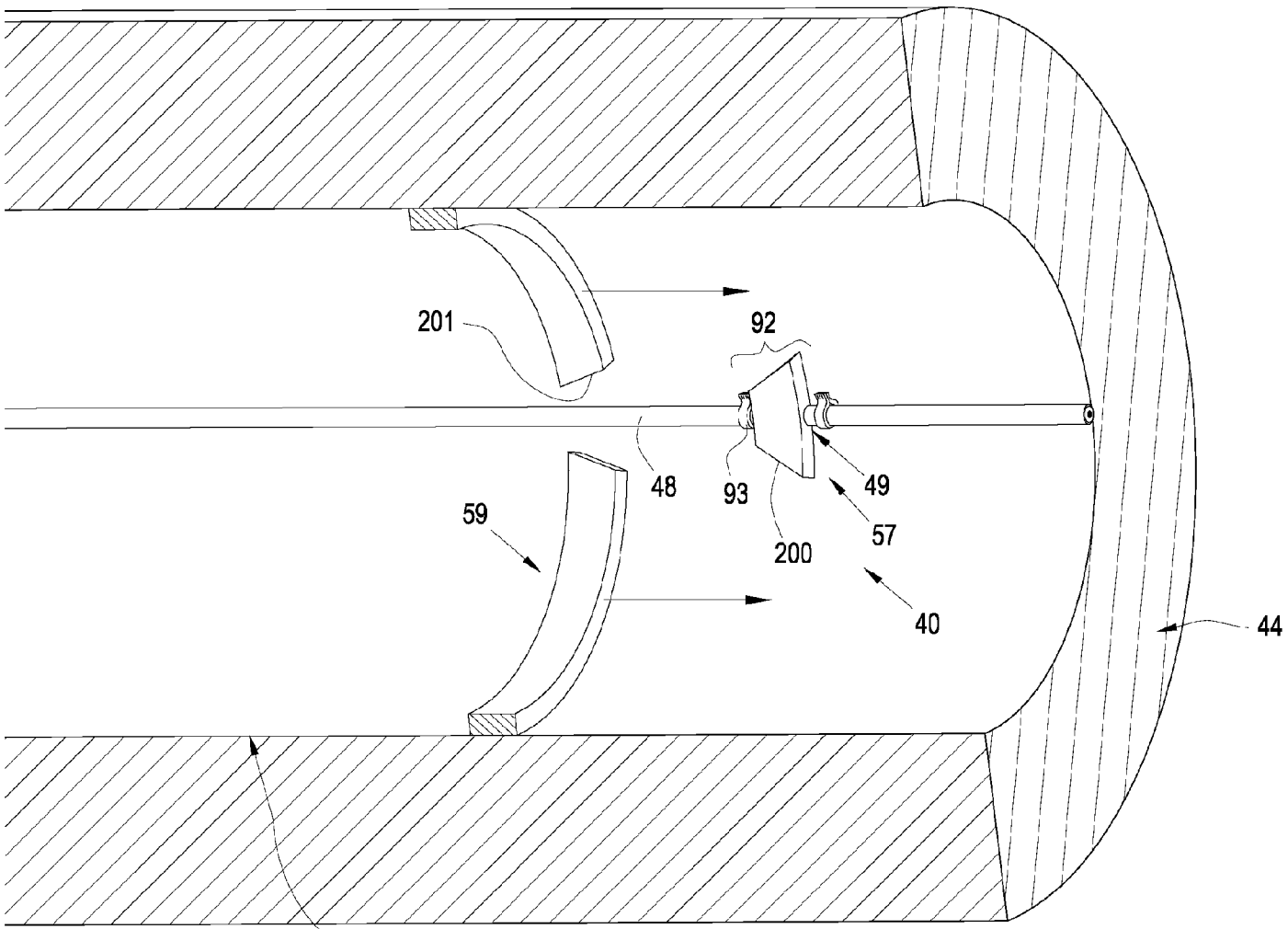
FIG. 15 is a perspective cross sectional diagram of a hanger being secured within a bore.

FIG. 15 is a perspective cross sectional diagram of a hanger 40 being secured within a bore 44. The tapered key 57 is fastened by a fastener 93 to a middle portion 92 of the conduit 48 in the bore 44. Fasteners 93 may comprise glue, bolts, welds, or washers. In alternative embodiments the conduit 48 may comprise a section with a diameter greater than the diameter of the passageway 49 such that the tapered key 57 is secured to the conduit 48 by a compression fit. After the key 57 is secured, the split ring 59 is inserted into the bore 44 to engage the tapered key 57. When the tapered key 57 and split ring 59 engage, the tapered key 57 may bias the split ring 59 such that the split ring 59 is held against the bore 44 by compression. This may be advantageous in embodiments comprising downhole tool string components, such as drill pipe, drill collars, heavyweight pipe, production pipe, and composite pipe. In directional drilling applications, a downhole tool string component may bend, which may allow a middle portion 92 of a conduit 48 to shift to the center of the bore if only the ends of the conduit 48 are secured to the component. A hanger 40 with a middle portion 92 of the conduit 48 retained within a passageway 49 may substantially retain the entire conduit 48 disposed within a downhole component against the bore wall 94. Multiple hangers 40 may be used in a downhole tool string component to help retain the conduit 48 against the bore wall 94.

Figure 16:
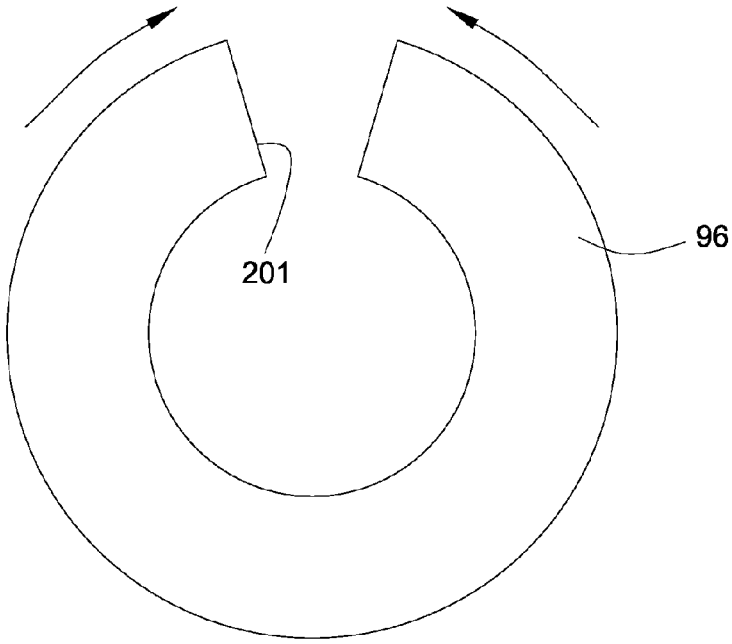
FIG. 16 is a top diagram of a flexible sleeve.

In other embodiments, it may be desirable to secure the hanger 40 in a portion of the bore 44 that comprises a larger diameter than a diameter available to enter the bore 44. For example the ends of some drill pipe comprise a narrower internal diameter than the internal diameter in the central portion of the drill pipe. To enter through the ends of these pipes, it may be desirable to reduce the diameter of the split ring 59 in order to pass through the narrower diameter before entering into the central portion of the pipe. In such embodiments, the split ring 59 may be a flexible sleeve 96. FIG. 16 is a top diagram of a flexible sleeve 96. The tapered key 57 may be inserted after the split ring 59 is within the larger diameter portion of the bore 44, and may spread the split ring 59 outward fixing the split ring 59 against the bore wall 94 as shown in FIG. 15.

Figure 17:
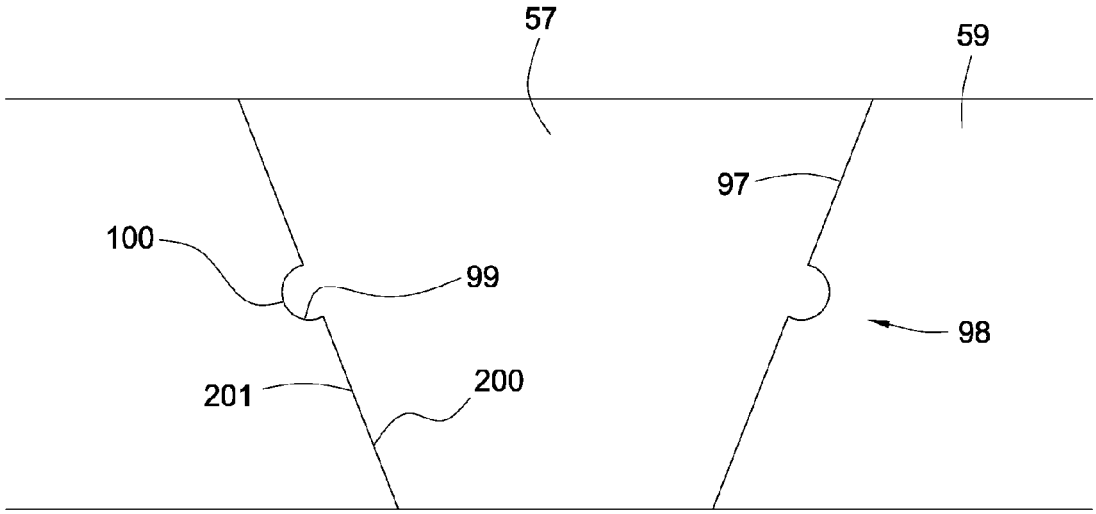
FIG. 17 is a cross sectional diagram of an anti-slide lock.

In some embodiments, in order to secure the tapered key 57 within the split ring 59, the interface 97 between the tapered key 57 and split ring 59 may comprise an anti-slide lock 98, as shown in FIG. 17. The lock 98 may comprise a protrusion 99 formed in the tapered key 57 fitted into a groove 100 formed in the split ring 59. In other embodiments, the groove 100 may be formed in the tapered key 57 and the protrusions 99 in the split ring 59. Alternatively, glue, bolts, or welds may also be used to lock the tapered key 57 within the split ring 59.

Figure 18:
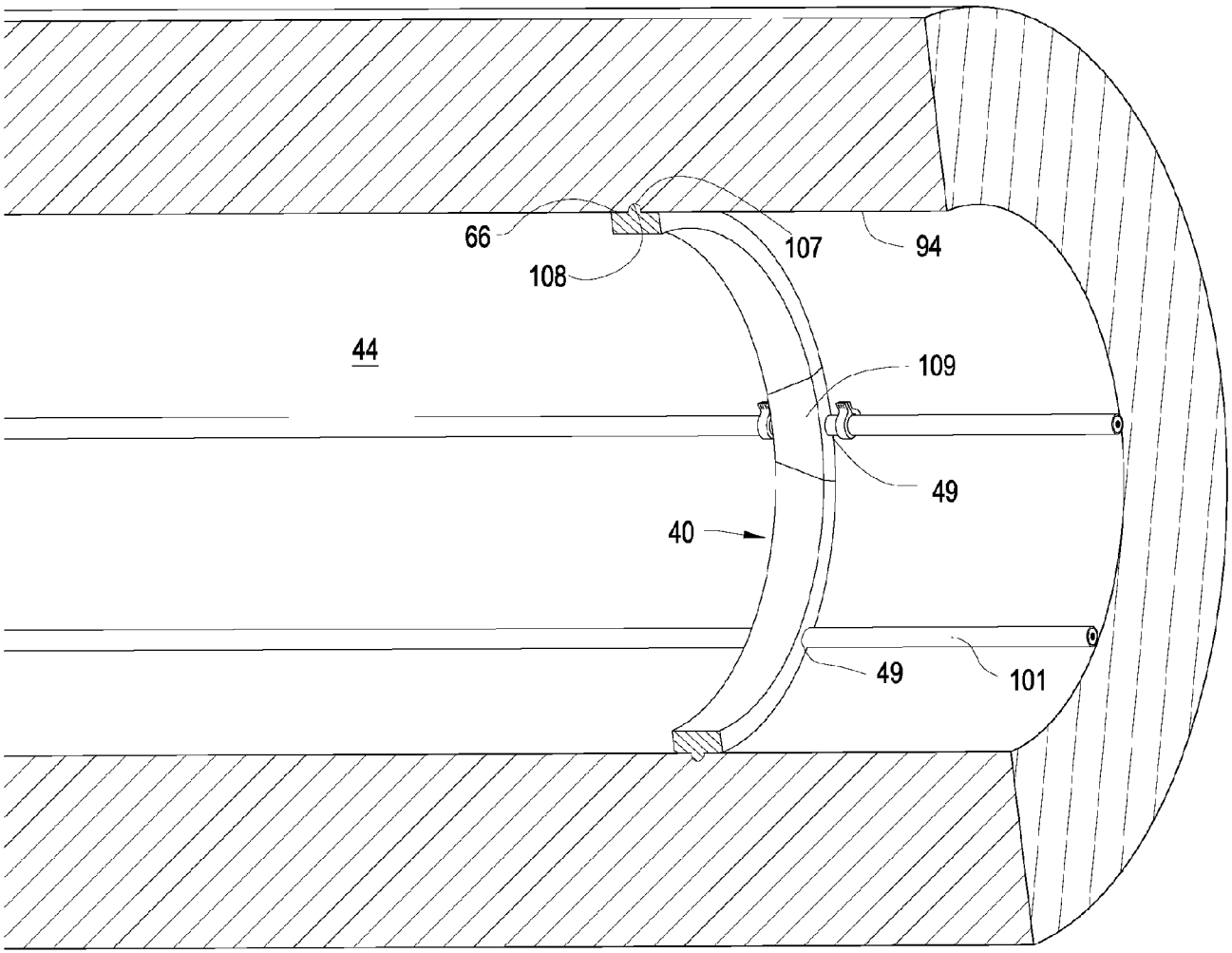
FIG. 18 is a perspective cross sectional diagram comprising multiple passageways.

In some embodiments, the hanger 40 may comprise multiple passageways 49 as shown in FIG. 18. A second conduit 101 may also comprise a conductive medium which may be used to transmit power, data, or network packets. The interface 66 between the hanger 40 and the bore wall 94 may be non-uniform. For example, a groove 108 formed in the bore wall 94 may interact with a protrusion 108 formed in the hanger 40, which may help fix the hanger 40 in a single position within the bore 44. Further a tapered key 109 is disclosed in FIG. 18; such a taper may help retain the key 109 within the split ring 59.

The hanger 40 may also comprise a lining (not shown) which contacts the bore 44. The lining may comprise an elastomeric material such as rubber, which may increase friction between an expanded hanger 40 and the bore 44. Further the lining may be used to prevent galvanic corrosion. It may be desirable in high temperature applications for the hanger 40 to comprise a material with a higher expansion rate than the bore, or in low temperature applications for the hanger 40 to comprise a lower thermal expansion rate than the bore. It may also be desirable for a lining to expand faster than the bore 44 and the hanger 40 such that it increases the friction between the hanger 40 and the bore 44.

Figure 19:
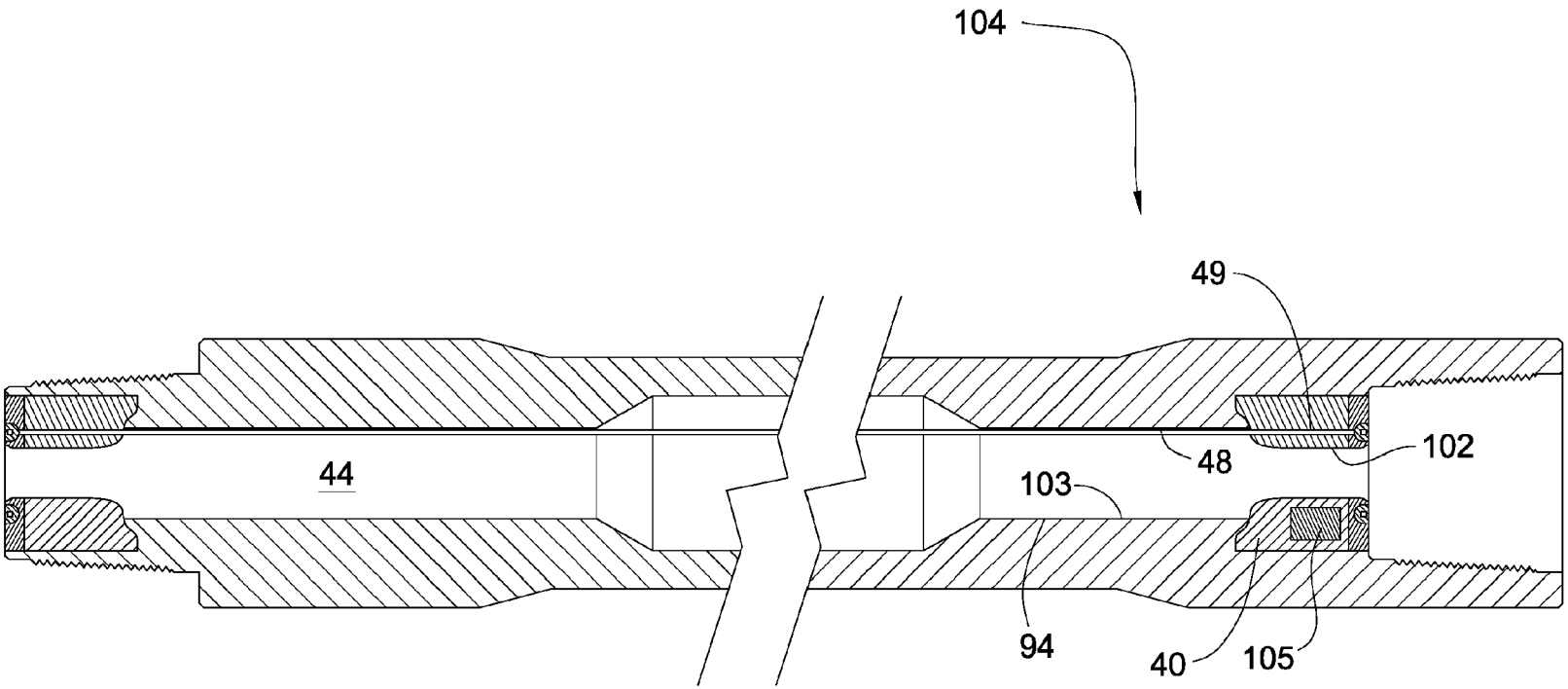
FIG. 19 is a cross sectional diagram of another embodiment of a hanger.

FIG. 19 is a cross sectional diagram of another embodiment of a hanger 40. The hanger 40 comprises an internal diameter 102 narrower than the diameter 103 of the bore 44 in the pipe 104. This may allow for a conduit 48 to exit into the bore 44 from the passageway 49 and stay adjacent to the bore wall 94 without bending. This may be desirable to reduce stresses on the conduit 48. Further in embodiments where the conductive medium comprises an optical fiber, it may be desirable to have a straight conduit 48.

The hanger 40 may also comprise electronic equipment 105. The electrical equipment may communicate with the conductive medium of the conduit 48, which may be relayed to surface or downhole equipment 35, 37 (see FIG. 1). The electrical equipment 105 may be selected from generators, batteries, microcontrollers, radio identification tags, antennas, switches, modems, optical regenerators, routers, memory, wireless transceivers, digital/optical converters, analog/optical converters, capacitors, sensors, switches, repeater and amplifiers.

A generator compatible with the present invention is disclosed in U.S. application Ser. No. 10/982,612, which is herein incorporated by reference for all that it discloses. Batteries compatible with the present invention are disclosed in U.S. Patent Publication Nos. 20040248000 and 20040248001 which are both herein incorporated by reference for all that they disclose.

Figure 20:
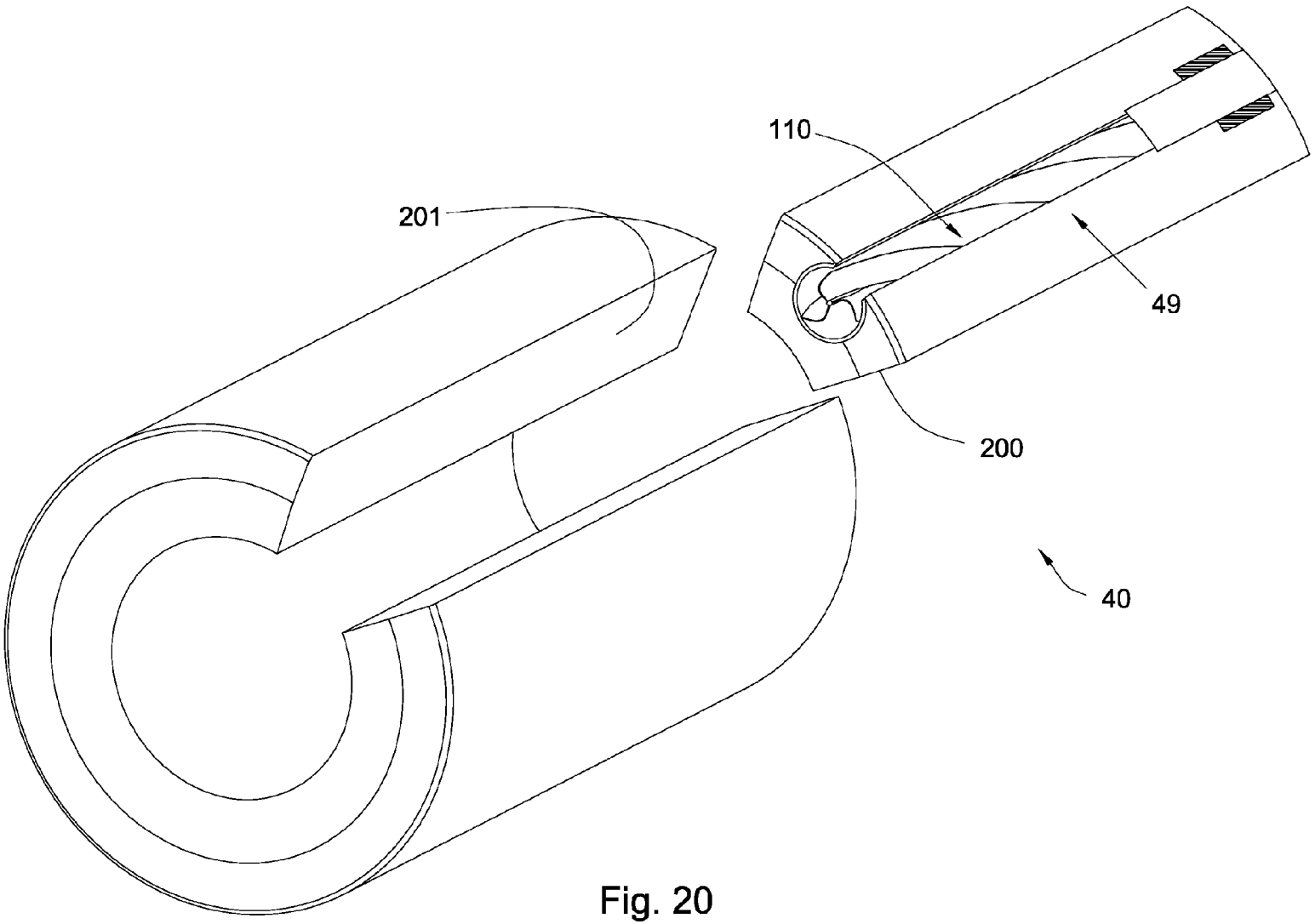
FIG. 20 is a cross sectional diagram of electronic equipment disposed within a passageway.

FIG. 20 is a cross sectional diagram of a generator 110 disposed within a passageway 49 of the hanger 40.

Figure 21:
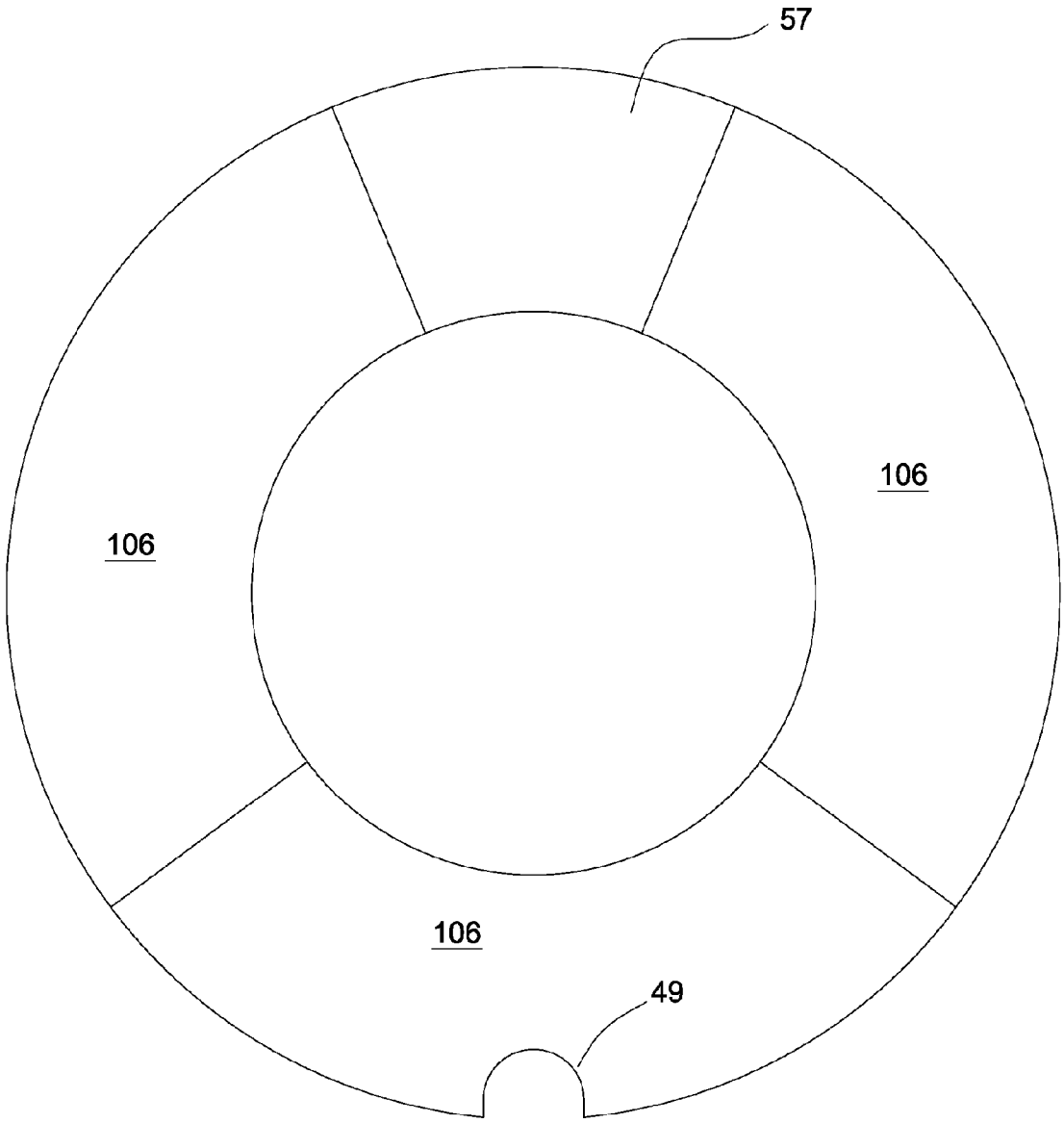
FIG. 21 is a top diagram of a segmented hanger.

In some embodiments of the present invention, the split ring 59 may have segments 106, as shown in FIG. 21. This may be desirable where the hanger 40 must pass through a very narrow diameter before the hanger 40 may be secured in a portion of the bore 44 comprising a much larger diameter.

Whereas the present invention has been described in particular relation to the drawings attached hereto, it should be understood that other and further modifications apart from those shown or suggested herein, may be made within the scope and spirit of the present invention.

What is claimed is:

1. A hanger mounted within a bore of a tubular string component, the hanger comprising:

a tapered key, a split ring and a passageway formed in the hanger;

the split ring having interfacial surfaces cooperating with corresponding interfacial surfaces of the tapered key, wherein an interface between the hanger and the bore comprises an anti-rotation lock.

2. The hanger of claim 1, wherein the tubular string component is selected from the group consisting of pipe, drill pipe, single shouldered pipe, double shouldered pipe, drill collars, reamers, production pipe, composite pipe, well casing, risers, underground utility lines, rotors, positive displacement rotors, jars, shock absorbers, heavy weight drill pipe, hammers, and turbines.

3. The hanger of claim 1, wherein a transmission element is disposed within a groove formed in the hanger.

4. The hanger of claim 3, wherein the transmission element is selected from the group consisting of direct electrical couplers, optical couplers, and inductive couplers.

5. The hanger of claim 1, wherein the hanger is locked in a position within the bore.

6. The hanger of claim 1, wherein the hanger is disposed within a recess formed in the bore.

7. The hanger of claim 1, wherein the hanger comprises a beveled end.

8. The hanger of claim 1, wherein the split ring is segmented.

9. The hanger of claim 1, wherein the split ring is a flexible sleeve.

10. The hanger of claim 1, wherein the anti-rotation lock comprises a pin.

11. The hanger of claim 1, wherein the anti-rotation lock is formed in the hanger.

12. The hanger of claim 1, wherein the interface between the hanger and the bore is non-uniform.

13. The hanger of claim 1, wherein the cooperating interfacial surfaces comprise an anti-sliding lock.

14. The hanger of claim 1, wherein the passageway is formed in the tapered key or split ring.

15. The hanger of claim 1, wherein a portion of a conduit is disposed within the passageway.

16. The hanger of claim 15, wherein the conduit comprises a transmission medium selected from the group consisting of coaxial cables, twisted pairs of wires, triaxial cables, twin axial cables, ribbon cables, optical fibers, and copper wires.

17. The hanger of claim 15, wherein the conduit is anchored within the passageway.

18. The hanger of claim 15, wherein the conduit terminates within the passageway.

19. The hanger of claim 15, wherein the conduit retains the conduit against the bore.

20. The hanger of claim 1, wherein the hanger comprises electrical equipment.

21. The hanger of claim 20, wherein the electronic electrical equipment is disposed within the passageway.

22. The hanger of claim 20, wherein the electrical equipment is selected from the group consisting of generators, batteries, microcontrollers, radio identification tags, switches, antennas, modems, optical regenerators, routers, memory, wireless transceivers, digital/optical converters, analog/optical converters, capacitors, sensors, switches, repeater and amplifiers.

23. The hanger of claim 1, wherein the hanger comprises a lining which contacts the bore.

* * * * *